United States Patent [19]

Swim

[11] Patent Number: 4,630,385

[45] Date of Patent: Dec. 23, 1986

[54] RECORD ALBUM LABELING TAB

[76] Inventor: Steven M. Swim, 7634 S. 41st St., Phoenix, Ariz. 85040

[21] Appl. No.: 680,099

[22] Filed: Dec. 10, 1984

[51] Int. Cl.[4] ..... G09F 3/00

[52] U.S. Cl. ..... 40/340; 40/23 A

[58] Field of Search ..... 40/23 A, 23 R, 10 R, 40/16 R, 16, 340

[56] References Cited

U.S. PATENT DOCUMENTS

| | | | |
|---|---|---|---|
| 2,248,355 | 7/1941 | Jones | 40/23 A |
| 2,771,076 | 11/1956 | Peter | 40/340 |
| 3,062,217 | 11/1962 | Woodhouse | 40/23 A |
| 3,204,639 | 9/1965 | Kleffman | 40/360 |
| 4,232,461 | 11/1980 | Crawford | 40/340 |

*Primary Examiner*—Gene Mancene
*Assistant Examiner*—Wenceslao J. Contreras
*Attorney, Agent, or Firm*—Drummond & Nissle

[57] ABSTRACT

An improved index marker. The index marker is adapted to be mounted on panel members of differing thickness and to be detachably glued to a panel member. In an alternate embodiment of the invention the index marker is movable between two operative positions when mounted on the edge of a panel member, a first operative position in which the index marker fixedly engages the panel and cannot be removed therefrom, and a second operative position in which the index marker slidably engages and can be removed from the panel member.

2 Claims, 9 Drawing Figures

RECORD ALBUM LABELING TAB

This invention relates to apparatus for indexing a group of objects.

More particularly, the invention pertains to an index marker adapted to be mounted on panel members of differing thickness and to be detachably glued to panel members.

In another respect, the invention pertains to an index marker which is movable between two operative positions when mounted on the edge of a panel member, a first operative position in which the marker fixedly engages the panel and cannot be pulled therefrom, and a second operative position in which the index marker slidably engages and can be removed from the panel member.

Index markers are well known in the art. See for example, U.S. Pat. Nos. 2,538,361 to Furrer, 2,910,985 to Epstein et al, 3,062,217 to Woodhouse, Jr., 4,209,925 to Briigmann, 4,218,838 to Zippel, and 4,232,461 to Crawford. Such prior art index markers are normally sized to fit a folder or other panel member having a particular thickness and cannot be readily attached to panel members of differing thicknesses. Another limitation of conventional index markers is that they are often fabricated to be permanently affixed to a panel-shaped member with adhesive and cannot be readily detached without damaging the index marker and the surface of the panel-shaped member. If adhesive is not utilized on this type of conventional index marker, a marker mounted on the edge of a panel member slides freelyC from the panel member when grasped and pulled in a direction away from the member.

Certain conventional prior art index markers can be detachably mounted on a panel-shaped piece of material without adhesive but require that an aperture be formed through and near the edge of the material. The disadvantage of this type of index marker is that it is often desirable to be able to utilize an index marker on a panel-shaped piece of material without defacing the material by cutting an opening through the material.

Accordingly, it would be highly desirable to provide an index marker which could be readily mounted on panel members of differing thickness and which would, without requiring the use of adhesive, adhere to the panel member so the index marker could be grasped and utilized to lift the panel member.

It would also be highly desirable to provide an index marker of the type described which could be affixed to a panel member without cutting an aperture through the member and could be quickly and conveniently removed from the panel member without damaging the index marker or the panel member.

These and other, further and more specific objects and advantages of the invention will be apparent to those skilled in the art from the following detailed description thereof, taken in conjunction with the drawings, in which.

Figure 1:
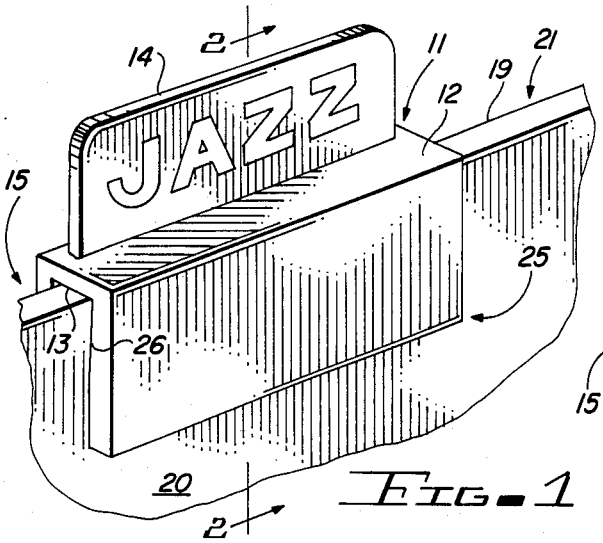
FIG. 1 is a perspective view illustrating an index marker constructed in accordance with the principles of the invention and mounted on the edge of a panel-shaped member.

Briefly, in accordance with my invention, I provide an improved index marker for panel-shaped members. The panel-shaped members each include an edge and a pair of opposed surfaces terminating at the edge. The index marker includes a base having a top side and a bottom side; a tab attached to the top side of and outwardly projecting from the base; a first resilient leg attached to the bottom side of and outwardly projecting from the base in a direction away from the tab and having a distal tip and an inner surface; and, a second resilient leg attached to the bottom side of and outwardly projecting from the base in a direction away from the tab and having a distal tip and an inner surface. The inner surface of the second leg is spaced apart from and opposed to the inner surface of the first leg. A portion of the bottom side of the base is between and bordered by the first and second legs. The resilient first and second legs normally cant toward one another such that the legs are spaced farther apart from one another near the bottom side of the base than the legs are spaced apart near the distal tips thereof, the distal tips being resiliently forced apart when the edge of the panel member is inserted therebetween. The portion of the bottom side of the base bordered by the legs is shaped and dimensioned to receive the edge of either of a first panel member and a second panel member, the first and second panel member being of differing thickness. The index marker can include an aperture formed through one of the legs to receive adhesive to affix the index marker to one of the panel members after the edge of the panel member is inserted between the legs of the index marker.

In an alternate embodiment of the invention I provide an improved index marker for a panel member. The panel member includes an edge and a pair of opposed surfaces terminating at the edge. The improved index marker includes a base having a top side and a bottom side; a tab attached to the top side of and outwardly projecting from the base; a first leg attached to the bottom side of and outwardly projecting from the base in a direction away from the tab and having a distal tip and an inner surface, the distal tip being shaped and dimensioned to slidably engage either of the surfaces of the panel member; a second leg attached to the bottom side of and outwardly projecting from the base in a direction away from the tab and having a distal tip and an inner surface, the inner surface of the second leg being generally spaced apart from and opposed to the inner surface of the first leg, a portion of the bottom side of the base being between and bordered by the first and second legs; outwardly projecting teeth means attached to the inner surface of the first leg between the distal end thereof and the bottom side of the base and shaped and dimensioned to engage one of the opposing surfaces of the panel member and resist movement of the member over the surface; adhesive means attached to the inner surface of the second leg at the distal end thereof, the adhesive means being adapted to detachably adhere to one of the surfaces of the panel member. The inner surfaces and the portion of the bottom side of the base are shaped and dimensioned such that the index marker can be moved between at least two operative positions. In the first operative position the teeth means engage one of the opposing surfaces of the panel member, the detachable adhesive means engages the other of the opposing surfaces of the panel member, and the distal end of the first leg is spaced away from said one of the opposing surfaces of the panel member. In the second operative position the teeth means and detachable adhesive means are disengaged and spaced away from the surfaces of the panel member and the distal tip of the first leg slidably engages said one of the opposing surfaces of the panel member.

Turning now to the drawings, which depict the presently preferred embodiments of the invention for the purpose of illustrating the practice thereof and not by way of limitation of the scope of the invention, and in which identical reference characters represent corresponding elements throughout the several views, FIGS. 1 to 4 illustrate one embodiment of the invention including an elongate base 11 having a top side 12 and a bottom side 13. Tab 14 is attached to and outwardly projects from top side 12. Leg 15 is connected to and downwardly depends from bottom surface 13 and includes inner surface 18. Nub 17 formed on the inner surface 18 of distal end 16 of leg 15 is shaped to slide over a surface 19 of panel member 21. Teeth 22 are formed on the inner surface 18 between bottom side 13 and the distal end 16 of leg 15. As can be seen in FIG. 2A, surface 18 is generally parallel to axis line 14A of tab 14. In FIG. 2A line 14A represents a plane perpendicular to the plane of the sheet of paper of the drawings. Leg 25 is attached to and outwardly depends from the bottom side 13 of base member 11. The inner surface 26 of leg 25 slopes away from surface 20 of panel member 11 and from axis line 14A. Inner surface 27 of the distal end 29 of leg 25 is provided with a material 28 which, when contacted with panel member 21, adheres to surface 20. However, when distal end 29 is displaced away from surface 20 in the direction of arrow A in FIG. 2B, material 28 will readily separate from surface 20. Material 28 preferably detachably adheres to surface 20 in the same manner that SARAN WRAP ® adheres to the surface of a bowl or other dish.

Figure 2A:
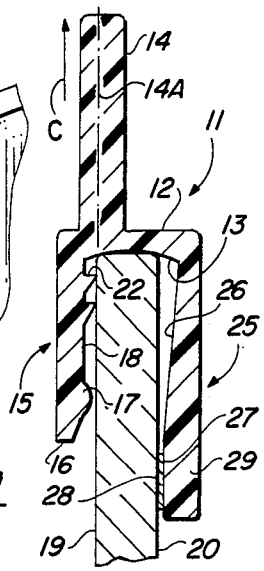
FIGS. 2A–2C are side section views of the index marker of FIG. 1 taken along section line 2—2 thereof and illustrating the mode of operation thereof.

As shown in FIG. 2A, when the index marker is mounted in its first normal operative position on the edge of panel member 21, teeth 22 and adhesive pad 28 engage surfaces 19, 20, respectively, of member 21; nub 17 is spaced away from surface 19; and, inner surface 26 is spaced away from surface 20. When the index marker is in its first operative position, teeth 22 and adhesive material 28 engage surfaces 19, 20 and generally prevent the index marker of the invention from readily moving with respect to panel member 21 when tab 14 is grasped and pulled in the direction of arrow C. The positioning of the axis 14A of tab 14 over and parallel to surface 19 facilitates the engagement of teeth 22 with surface 19 when tab 14 is pulled away from member 21 in the direction of arrow C in FIG. 2A.

Figure 2B:
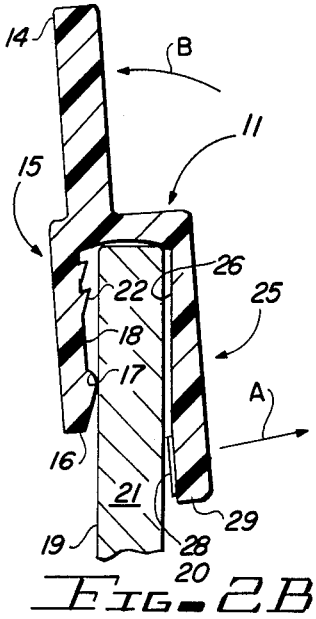
Figure 3:
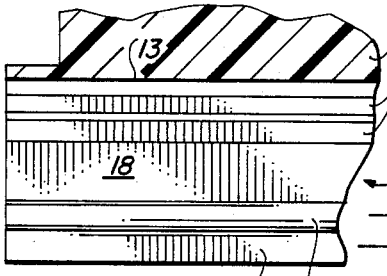
FIG. 3 is a section view of the index marker of FIG. 2C taken along section line 3—3 thereof.
Figure 4:
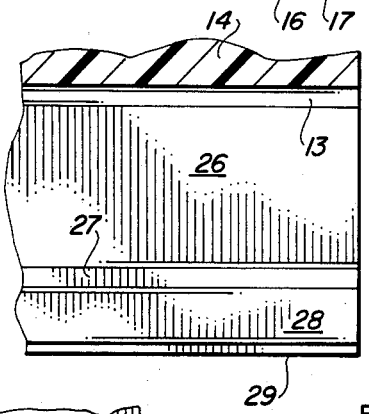
FIG. 4 is a section view of the index marker of FIG. 2C taken along section line 4—4 thereof.

The second operative position of the index marker is illustrated in FIG. 2B. The index marker is moved from the first operative position of FIG. 2A to the second operative position of FIG. 2B by displacing tab 14 in the direction of arrow B in FIG. 2B. When the index marker is in the second operative position teeth 22 and adhesive pad 28 are disengaged from and spaced away from surfaces 19, 20, respectively; nub 17 contacts surface 19, and surface 26 contacts surface 20 of member 21. The arcuate convex shape of bottom surface 13 facilitates movement of the index marker between the first and second operative positions.

Figure 2C:
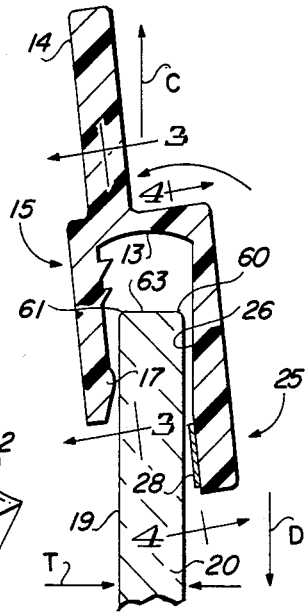
Figure 7:
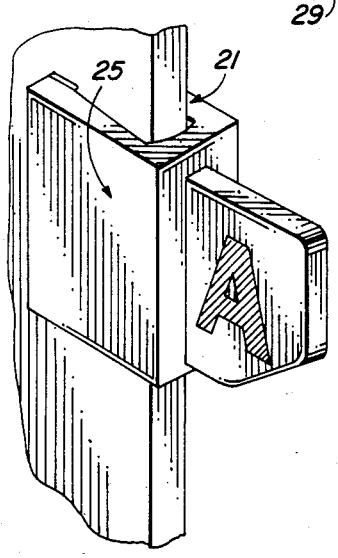
FIG. 7 is a perspective view of an index marker provided with a tab shaped and dimensioned to distinguish the marker from the index marker of FIG. 1.

Once the index marker is in the second operative position of FIG. 2B, it is removed from panel member 21 by grasping tab 14 and pulling the marker in the direction of arrow C in the manner illustrated in FIG. 2C. When tab 14 is pulled in the direction of arrow C, nub 17 and surface 26 slide over surfaces 19, 20 to permit the index marker to be removed from panel member 21. When an individual is grasping tab 14 with one hand and pulling the index marker in the direction of arrow C in FIG. 2C, he normally holds panel member 21 in stationary position with his other hand.

Figure 5:
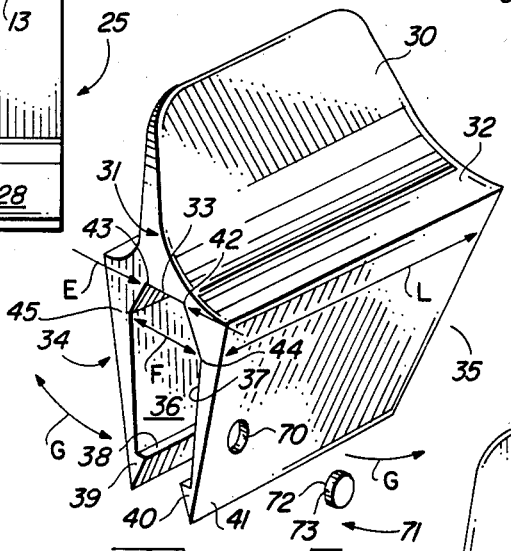
FIG. 5 is a perspective view of an alternate embodiment of the index marker of the invention.
Figure 6:
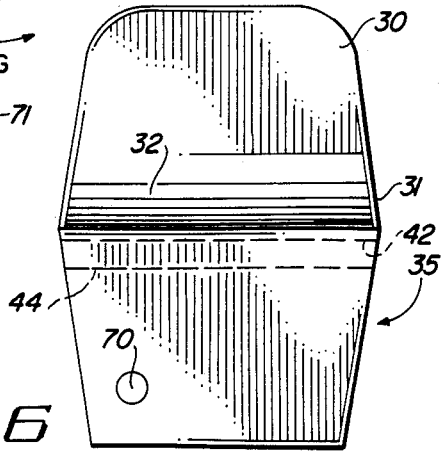
FIG. 6 is a front view of the index marker of FIG. 5.

An alternate embodiment of the invention is illustrated in FIGS. 5 and 6 and includes tab 30 attached to and projecting outwardly from base member 31 having a top side 32 and bottom side 33. Resilient legs 34, 35 are attached to and downwardly project from bottom side 33 of base 31. Leg 34 includes inner surface 36 and tooth 38 formed on the distal end 39 of leg 34. Tooth 40 is formed on the inner surface 37 of leg 35 at the distal end 41 thereof.

The distance represented by arrows E in FIG. 5 is greater than the distance represented by arrows F. The shortest distance between teeth 38, 40 is less than the distance represented by arrows E. The index marker of FIGS. 5 and 6 is intended for panel members having a thickness T (FIG. 2C) which is either equal to the distance indicated by arrows E or to the distance represented by arrows F. When a panel member inserted between resilient legs 34, 35 has a thickness equal to that represented by arrows E, legs 34, 35 are displaced in the direction of arrows G and the top edge 63 (FIG. 2C) of the panel member contacts bottom surface 33. The upper elongate edges 60, 61 (FIG. 2C) of the panel member contact and fit in elongate corners 42, 43 extending the length L of the index marker. When the panel member inserted between resilient legs 34, 35 has a thickness equal to that represented by arrows F, legs 34, 35 are displaced in the direction of arrows G, the upper elongate edges 60, 61 (FIG. 2C) of the panel member contact and fit in elongate corners 44, 45, and upper surface 63 is spaced away from bottom side 33 of the index marker. When a panel member of thickness E or F is inserted between legs 34, 35, the resiliency of the legs forces teeth 38, 41 against the panel member.

Aperture 70 is formed through leg 35. After the index marker has been mounted on a panel member, a drop of adhesive can be placed in aperture 70 to secure the index marker to the panel member. The adhesive normally contacts aperture 70, a portion of inner surface 37, and the panel member. Since the glue contacts a relatively small portion of the panel member and the index marker, the index marker can be quickly removed from the panel member with minimal or no damage. The adhesive utilized is preferably of a type which can be readily separated from the material comprising index marker so that when leg 35 is pried away from the panel member after a drop of glue is placed in aperture 70 and has set, the hardened drop of glue separates from aperture 70 and remains attached to the panel member.

A small cylindrical plug 71 of paper or other material can, after the index marker of FIG. 5 is mounted on a panel member, be inserted in aperture 70. The back side 72 of plug 71 is provided with adhesive which secures the plug to the surface of the panel member. Plug 71 is thick enough to extend outwardly from the panel member and into aperture 70 such that when tab 30 is grasped and pulled in an attempt to remove the index marker from the panel member, aperture 70 bears against the peripheral surface 73 of plug 71 and maintains the index marker in position on the panel member. Since plug 71 is not glued to aperture 70 or leg 35, the index marker can be removed from the panel member by pulling resilient leg 35 outwardly from the panel member to disengage aperture 70 from plug 71 and by then pulling the index marker off of the panel member. After the index marker is removed from the panel member, plug 71 remains secured to the panel member by the adhesive on the back surface 72 of the plug. If desired, the index marker of FIG. 5 can be replaced on the panel member such that plug 71 again extends from the panel member into aperture 70 of the index marker.

Having described my invention in such terms as to enable those skilled in the art to understand and practice it, and having identified the presently preferred embodiments and best mode thereof, I claim:

1. An index marker for panel-shaped members, said panel-shaped members each including an edge, and a pair of opposed generally smooth planar sufaces terminating at said edge, said index marker including (a) a base having a top side and a bottom side;

(b) a tab attached to said top side of and outwardly projecting from said base;

(c) a first resilient leg attached to said bottom side of and outwardly projecting from said base in a direction away from said tab and having a distal tip and an inner surface;

(d) a second resilient leg attached to said bottom side of and outwardly projecting from said base in a direction away from said tab and having a distal tip and an inner surface, said inner surface of said second leg generally being spaced apart from and opposed to said inner surface of said first leg, a portion of said bottom side of said base being between and bordered by said first and second legs;

said resilient first and second legs normally canting toward one another such that said legs are spaced farther apart from one another near said bottom side of said base than said legs are spaced apart near said distal tips thereof, said distal tips being resiliently forced apart when said edge of said panel member is inserted between said legs;

said portion of said bottom side of said base being shaped and dimensioned to receive the edge of either of a first panel member and a second panel member, said first and second panel members being of differing thickness;

said index marker being mounted on said panel member by grasping said tab and sliding said distal tips onto said smooth planar surfaces in a direction of travel parallel to said surfaces and generally perpendicular to and toward said edge;

said index marker being removed from said panel member by manually grasping said tab and pulling said index marker in a direction of travel generally away from and perpendicular to said edge and parallel to said planar surfaces of said panel member;

said distal ends of said legs sliding over said planar surfaces during installation and removal of said index marker onto and from said panel member;

said edge of each of said first and second panel members including a pair of elongate spaced apart generally parallel corners;

said portion of said bottom side of said base including first and second pairs of elongate generally parallel spaced apart corners; and said first pair of corners of said base being sized to contact and receive said corners of said first panel member, and said second pair of corners of said base being sized to contact and receive said corners of said second panel member; and (e) at least one aperture formed through one of said legs thereof to receive plug means to affix said index marker to one of said panel members after said edge of said panel member is inserted between said legs thereof, said plug means being secured to said panel member and extending outwardly therefrom into said aperture to prevent said aperture and said one of said legs from being displaced in a direction of travel generally parallel said planar surfaces of said panel member.

2. A method for mounting an index marker on a panel-shaped member, said member including an edge, and a pair of opposed generally smooth planar surfaces terminating at said edge, said method including the steps of (a) placing said index marker on the edge of said panel-shaped member, said index marker including (i) a base having a top side and a bottom side;

(ii) a tab attached to said top side of and outwardly projecting from said base;

(iii) a first resilient leg attached to said bottom side of and outwardly projecting from said base in a direction away from said tab and having a distal tip and an inner surface;

(iv) a second resilient leg attached to said bottom side of and outwardly projecting from said base in a direction away from said tab and having a distal tip and an inner surface, said inner surface of said second leg generally being spaced apart from and opposed to said inner surface of said first leg;

said resilient first and second legs normally canting toward one another such that said opposed legs are spaced farther apart from one another near said bottom side of said base than said legs are spaced apart near said distal tips thereof, said distal tips being resiliently forced apart when said edge of said panel member is inserted between said legs;

(v) at least one aperture formed through one of said first and second legs; and, (b) filling said aperture with plug means, said plug means being secured to said panel member and extending outwardly therefrom into said aperture to prevent said aperture from being displaced in a direction of travel generally parallel said planar surfaces of said panel member.

* * * * *